United States Patent [19]

Thevis et al.

[11] Patent Number: 4,523,509

[45] Date of Patent: Jun. 18, 1985

[54] SHOULDER ARM

[75] Inventors: Paul Thevis, Oberndorf; Helmut Danner, Sulz-Sigmarswangen; Erich Weisser, Tennenbronn, all of Fed. Rep. of Germany

[73] Assignee: Heckler & Koch GmbH, Fed. Rep. of Germany

[21] Appl. No.: 402,268

[22] Filed: Jul. 27, 1982

[30] Foreign Application Priority Data

Aug. 4, 1981 [DE] Fed. Rep. of Germany ..... 3130761

[51] Int. Cl.[3] ..... F41D 11/10

[52] U.S. Cl. ..... 89/129.02; 89/131; 89/198

[58] Field of Search ..... 89/129 R, 129 B, 131, 89/198; 16/66, 84, DIG. 9, DIG. 10; 188/284, 322.11, 322.17, 322.18; 267/114, 129

[56] References Cited

U.S. PATENT DOCUMENTS

| | | | |
|---|---|---|---|
| 1,464,276 | 8/1923 | Vincon | 89/131 |
| 1,604,447 | 10/1926 | Heuser | 16/84 |
| 2,791,942 | 5/1957 | Fletcher | 89/131 |
| 2,873,650 | 2/1959 | Pinkerton | 89/131 |
| 3,650,177 | 3/1972 | Hupp et al. | 89/198 |
| 3,847,054 | 11/1974 | Ruger et al. | 89/129 B |
| 4,024,792 | 5/1977 | Moller . | |
| 4,044,866 | 8/1977 | Ishida | 188/322.21 |

FOREIGN PATENT DOCUMENTS

| | | | |
|---|---|---|---|
| 591381 | 1/1934 | Fed. Rep. of Germany . | |
| 687499 | 1/1940 | Fed. Rep. of Germany . | |
| 1121981 | 1/1962 | Fed. Rep. of Germany . | |
| 1578367 | 1/1966 | Fed. Rep. of Germany . | |
| 2326525 | 5/1973 | Fed. Rep. of Germany . | |
| 2018620 | 3/1975 | Fed. Rep. of Germany . | |
| 2735188 | 5/1978 | Fed. Rep. of Germany . | |
| 594864 | 1/1978 | Switzerland . | |
| 5925 | of 1883 | United Kingdom | 16/66 |

OTHER PUBLICATIONS

Archer, Denis H. R., Jane's Infantry Weapons, 1976, p. 263.

*Primary Examiner*—Stephen C. Bentley

*Attorney, Agent, or Firm*—Leydig, Voit, Osann, Mayer and Holt, Ltd.

[57] ABSTRACT

The invention relates to an automatic shoulder arm, such as a machine gun, which can be changed over to semi-automatic fire, burst and automatic fire. In order to reduce the ammunition consumption in the automatic fire mode and to increase the hit rate, the weapon is provided with a mechanism regulating the cyclic rate of fire (27, 21 to 25) which reduces the cyclic rate of fire in the automatic fire position by means of a deceleration member (27) releasing the next shot. A hammer (14) acting upon a firing pin (10) when a shot is released is preferably releasable by deceleration member (27), which hammer is provided with an additional detent (24) being effective in the automatic fire position and disengageable by deceleration release lever (21). (FIG. 2*a*).

11 Claims, 5 Drawing Figures

SHOULDER ARM

Figure 1:
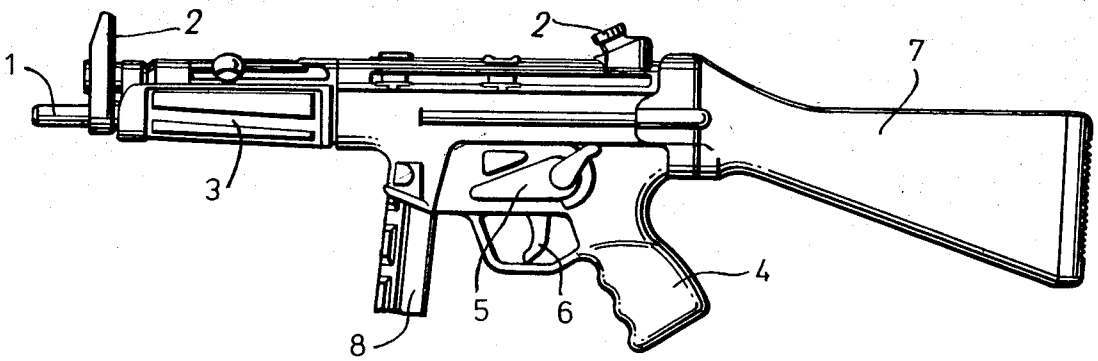

The invention relates to a shoulder arm which can be changed over to semi-automatic fire, burst, and automatic fire.

In the semi-automatic fire position one shot is released upon each pulling of the trigger. The ejection of the empty cartridge case (case ammunition), the cocking of the hammer and the insertion of the next cartridge into the barrel as well as closing of the bolt are performed automatically (automatic shoulder arm). In the burst position, a given number of shots, preferably three, is fired in rapid succession by the weapon if the trigger is pulled once. The cyclic rate of fire should then be as high as possible. Particularly in the case of mounted shoulder arms a high cyclic rate of fire is of importance, because the gunner will not perceive a reaction so that the weapon will not or only slightly be deflected from the target. It is thus achieved that all shots of one burst remain within a relatively narrow scatter area, which considerably increases the hitting probability. In the automatic fire position, however, shots are released as long as the trigger is kept in the pulled condition. At a high cyclic rate of fire of the weapon, for example, 900 to 1200 shots per minute, 15 to 20 shots would be released in one second. Because a gunner is hardly capable of pulling the trigger for a time significantly shorter than one second, such a high cyclic rate of fire is associated with a considerable consumption of ammunition, however, without resulting in an approximately proportional increase in hit rate because the weapon will wander further from the target with each shot.

The object of the present invention therefore is to design an automatic shoulder arm of the initially mentioned type in such a manner that its cyclic rate of fire is as high as possible in the burst position and considerably reduced in the automatic fire position.

With a shoulder arm of the initially mentioned type this problem is solved in accordance with the invention in that it is provided with a cyclic rate regulator which reduces the cyclic rate of fire in the automatic fire position by means of a deceleration member which enables the next shot to be released, in that a hammer is releasable by the deceleration member, which hammer acts upon a firing pin when a shot is released, in that the hammer is provided with an additional detent which is effective in the automatic fire position and can be disengaged by the deceleration member, and in that the additional detent of the hammer includes a deceleration release lever provided with a projection which engages a hammer detent and which can be disengaged by the deceleration member.

The advantage of a shoulder arm of such type is that in the burst position a very high cyclic rate of fire is possible which results in a high hit rate, particularly if the invention is realized in a mounted weapon as is known from German laid open patent application No. 23 26 525 and the corresponding U.S. Pat. No. 4,024,792. A mounted weapon of such type is capable of releasing three or more shots before the recoil affects the gunner and thus the alignment of the weapon. It is thus possible to keep the shots released in one burst within a very narrow scatter area. By reducing the cyclic rate of fire in the automatic fire position the ammunition consumption can be considerably decreased, and goal-directed shooting is possible for a trained gunner. The cyclic rate of fire is, for example, reduced to 300 or less shots per minute, i.e. to five or less shots per second.

It is further advantageous in that the delay time of the deceleration member can be selected independent of the kinematics and the sequences of motions of the weapon because the deceleration member does practically not interfere with the sequence of the weapon, but merely releases the hammer with time delay, which has no influence on the sequences of the bolt, cartridge feed and the like. The additional detent enables to essentially leave the trigger system of known weapons unmodified and to merely add the additional detent and the deceleration member.

Finally, it is advantageous that the deceleration release lever can be arranged in the desired manner at a distance from the other hammer detents, which again are preferably provided near the axis of rotation of the hammer. The deceleration lever can be designed of sufficient length so that a relatively small force is required by the deceleration member to disengage the deceleration release lever and to release the hammer. In a further preferred embodiment a locking surface for the deceleration release lever is provided in the end portion of the hammer far from the hammer rotation axis area.

The reduction of the cyclic rate of fire by means of the deceleration member can be made ineffective by maintaining the deceleration release lever in a position where it is always out of engagement with the locking surface at the hammer. A particularly suitable embodiment will be achieved if the safety pin provided for selecting standard operating modes is designed in such a manner that, when in burst position, it keeps the deceleration release lever in such a pivot angle position that its projection remains clear of the locking surface of the hammer detent. This embodiment is advantageous in that the safety pin in the burst position automatically renders the deceleration member ineffective, but, on the other hand, allows the deceleration member to become effective in the automatic fire position.

In a further embodiment where the deceleration release lever is made ineffective when "burst" is selected, the deceleration lever is disengaged from its effective position via a member of the automatic fire limiter limiting the number of shots in a burst. In the case of this embodiment the deceleration lever is only swivelled out and thus ineffective during counting of the shots, but effective when semi-automatic fire is selected, which, however, does not influence the actual operation.

The form and the functional design of the deceleration member can be chosen within a very wide range. It can, for example, be designed as a mechanic-hydraulic unit similar to a single-acting shock absorber, featuring a piston guided in a cylinder, with the cylinder being filled with hydraulic fluid and the piston being provided with throttles and non-return valves connected in parallel and loaded by a spring. Said deceleration member is activated by the piston moving in the direction which causes opening of the non-return valves. The spring then urges the piston to travel in the opposite direction so that the hydraulic fluid must flow through throttle openings in the piston which results in the desired deceleration. Hydraulically operated deceleration members, however, are disadvantageous in that their delay time is temperature-dependent because the viscosity of the fluid is a function of the prevailing temperature. In the case of a weapon, however, it is unacceptable that the delay time depends on the ambient temperature because its function must be ensured both under tropical as well as under arctic climatic conditions. It is therefore preferable to provide a mechanic-pneumatic deceleration member which comprises a spring-loaded piston and protrudes into the path of the bolt which, prior to the release of the next shot, displaces the piston and bends the piston spring which returns the piston with delay caused by a throttle. A pneumatic deceleration member functions reliably and practically completely unaffected by temperature variations. It can basically be built similar to the previously described shock absorber, i.e. hermetically sealed, which implies the advantage that it cannot be affected by dirt or dust.

According to a preferred embodiment of the invention the piston is provided with a cup leather serving as a non-return valve, and the cylinder guiding the piston is vented either on one or on both sides via a throttle which may be adjustable. This embodiment is characterized by a particularly simple construction because the piston is essentially formed by the cup leather which simultaneously fulfills the function of a non-return valve. By venting the cylinder space to the outside it is possible to install an externally adjustable throttle which is advantageous in that the delay time can be varied, which, however, will be significant only in exceptional cases, because in series production the installation of a fixed throttle is more suitable. The throttle of externally vented cylinders can be installed at the pressure and/or suction side.

Because the return motion of the piston which disengages the deceleration release lever and releases the shot is relatively slow, it is conceivable that irregular delay times result because of the only gradually increasing force which disengages the deceleration release lever. In a preferred embodiment of the invention the cylinder is provided with a cross hole which is exposed by the piston before it reaches its effective end position. Said cross hole thus causes the deceleration effected by the throttle to become ineffective and the piston to be moved without deceleration by the spring in that very moment when the piston has passed the cross hole. In this manner it is achieved that the deceleration release lever is subjected to the full and not decelerated force of the spring moving the piston. Thus a uniform and very reliable operation of the mechanism is achieved. A similar result can be obtained by guiding the piston rod in the carrier plate through a seal and providing it with a longitudinal slot which reaches and bridges the seal before the piston reaches its effective end position, or by providing a slot in the cylinder wall.

Generally, automatic shoulder arms of such type are provided with a recoil cushion for limiting the bolt recoil. In a preferred embodiment of the invention the recoil cushion is designed as a ring surrounding the piston rod of the deceleration member piston against which a collar attached to the piston rod abuts in the bolt end position. This allows the deceleration member to be arranged in the end portion of the bolt travel so that the deceleration member becomes an integral component of the weapon and a balanced and compact design is achieved.

Further details of the present invention and additional embodiments will become apparent from the following description of the embodiment shown in the drawing in connection with the claims. In a simplified and schematic manner and with all details of the weapon omitted, which are not required for the understanding of the invention.

FIG. 1 shows a side view of the weapon and

Figure 3:
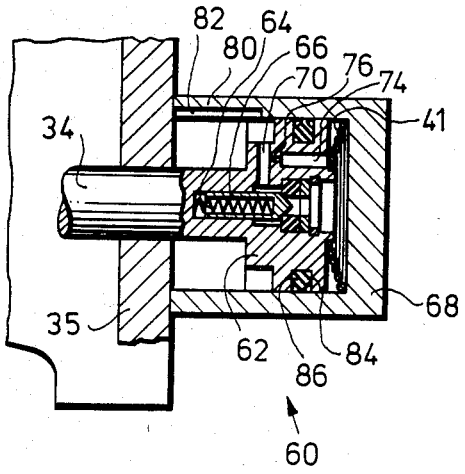

FIGS. *2a–c* are longitudinal sections through the trigger mechanism and various deceleration members serving as cyclic rate regulators in the automatic fire position with the trigger in the pulled condition;

FIG. 3 is a longitudinal section through another deceleration member.

The weapon shown in FIG. 1 which is an automatic rifle, comprises a barrel 1, a sight 2, a handguard 3 surrounding the rear portion of the barrel, a pistol grip 4 with a trigger 6 pivotably mounted in a trigger assembly housing 5 and a stock 7. In a magazine 8 arranged before trigger assembly housing 5 there is provided a cartridge supply. The weapon is designed as a recoil-operated rifle similar to the known G 3 rifle; it could be designed as gas-operated rifle as well. In each case, the shoulder arm comprises a bolt closing the barrel end, which returns after the release of a shot, ejects the empty cartridge case, advances under spring force and thus introduces the next cartridge into the chamber.

FIGS. *2a* to *c* show the rear portion of the bolt assembly, with the bolt being in its forward end position closing the chamber. A bolt carrier 9 with a firing pin 10 is movable along line 11 upon returning and advancing of the bolt. In trigger assembly housing 5 trigger 6 is supported to be rotatable about axis 12. A sear 13 is also mounted on axis 12 in a manner so as to be pivotable and longitudinally movable to a limited degree, as is known from the previously mentioned weapon. A hammer 14 can be pivoted about an axis 15 and is provided with a detent 16 and another detent 17 spaced at a small distance to its axis 15. Hammer 14 is loaded in a known manner by a hammer spring which causes the hammer after release as shown in FIG. *2a* to be swivelled to the left until it contacts firing pin 10 and thus releases the shot. A safety pin 18 is provided parallel to axes 12 and 15 which, in the safety engaged position locks a lug 19 of trigger 6 and thus, in a known manner, prevents pulling of the trigger 6, which is not illustrated. A deceleration release lever 21 is pivotably mounted on a further axis 20 which is loaded in the clockwise direction by a spring 22. Deceleration release lever 21 is provided with a projection 23 which engages a detent 24 which is machined in the end portion of hammer 14 remote from axis 15. Deceleration release lever 21 is, in addition, extended and protrudes with one arm into the path of a head 26 of a deceleration member 27 or 27' or 27'', respectively, with head 26 being also movable along line 11, whereby, however, arm 25 is laterally outside of the path of bolt carrier 9.

A catch 29 is rotably mounted on an axis 28, which catch is provided with a projection 30 against which hammer 14 with its detent 16 rests if catch 29 is not swivelled out. The end of the catch protrudes into the path of a release lever 31 attached to and movable with bolt carrier 9. With the bolt in the closed position catch 29 will be swivelled to such a position that projection 30 is outside the path of detent 16 and hammer 14 is thus able to hit firing pin 10, provided it is not restrained otherwise.

Deceleration members 27, 27' and 27'' comprise a cylinder 32 attached to trigger assembly housing 5 or to the bolt guide, in which cylinder a piston 33 is movably guided along line 11, which is provided with a piston rod 34 at whose end far from piston 33 head 26 is attached. Piston rod 34 is guided through a carrier plate 35 permanently mounted on the weapon, and a ring 36 made from a resilient material is provided between head 26 and carrier plate 35 surrounding piston rod 34 and serving as a cushion. Piston 33 comprises a supporting plate 37 and a guide plate 38 between which a cup leather 39 made from an elastic material is located in position. The open side of cup leather 39 faces towards head 26. A helical compression spring 41 bears against a bottom 40 of cylinder 32, which with its other end abuts guide plate 38 and loads piston 33 so that it attempts to move toward bolt carrier 9. In the case of deceleration members 27 and 27" (FIGS. 2*a* and 2*c*) a hole 42 is machined in bottom 40 of cylinder 32, which can partially or completely be covered by means of a plate 44 pivotably mounted by a screw 43. Cylinder 32 is additionally provided with a cross hole 45 whose location is so selected that cup leather 39 will have passed the hole under the action of compression spring 41 immediately before head 26 reaches arm 25.

Figure 2A:
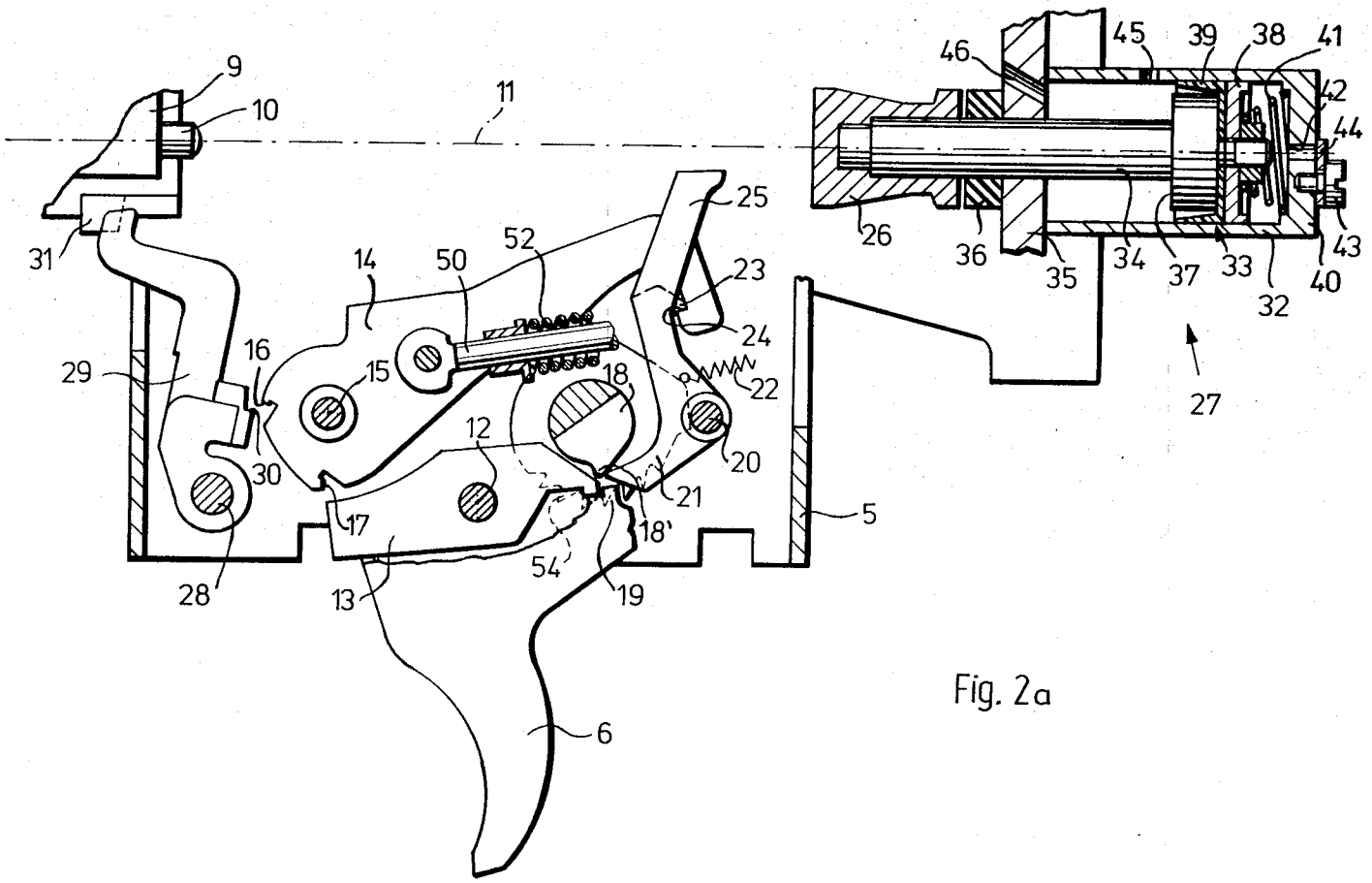

In the case of deceleration member 27 in accordance with FIG. 2*a*, only the vacuum in the space containing spring 41 is utilized for decelerating the motion of piston 33. Accordingly, a vent hole 46 with a sufficiently large cross section is provided in carrier plate 35. If, however, in the case of deceleration member 27' in accordance with FIG. 2*b* only the overpressure in the space of cylinder 32 opposite spring 41 is utilized for decelerating the motion of piston 33, hole 46' is provided instead of hole 42 and serves as a vent hole. A hole 42' provided in carrier plate 35 serves as a throttle which can completely or partially be covered by a plate 44' pivotably mounted by means of screw 43'. Hole 45 is then replaced by a longitudinal slot 45' in piston rod 34, which by means of an O-ring 47 in carrier plate 35 remains sealed until slot 45' extends to the outside through the sealed area. In the case of deceleration member 27" in accordance with FIG. 2*c* both the vacuum as well as the overpressure are utilized.

The various modes of fire, i.e. safety, semi-automatic fire, burst, and automatic fire are selected in the known manner by swivelling safety pin 18. In the safety position the safety pin locks lug 19 of trigger 6 as is also known from the standard weapons G 3 and HK 21 A 1. With the bolt in the closed position catch 29 is swivelled by release lever 31 and thus projection 30 out of engagement with detent 16.

If safety pin 18 is rotated to the semi-automatic fire position, trigger 6 can be swivelled and drives sear 13 whose projection is swivelled off detent 17 and releases hammer 14. After the shot has been released, the bolt returns, cocks hammer 14 and then advances again under the action of a recoil spring not illustrated. Hammer 14 is initially caught by projection 30 at detent 16 until bolt carrier 9 reaching the closing position swivels out catch 29 by means of release lever 31, whereupon hammer 14 with its detent 17 is caught by sear 13. The next shot can be released by pulling trigger 6 again.

In the burst position a cam 18' of safety pin 18 swivels deceleration lever 21 in such a manner that its projection 23 is out of engagement with detent 24 of hammer 14. This ensures that the next shot is always released when bolt carrier 9 reaches the bolt closing position and release lever 31 swivels out catch 29 so that projection 30 clears detent 16 and thus hammer 14 is released. In this mode of fire too, deceleration release lever 21 is ineffective.

Figure 2B:
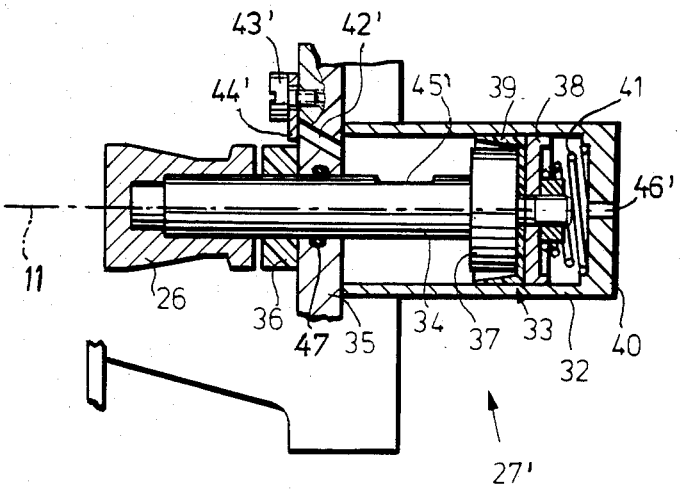
Figure 2C:
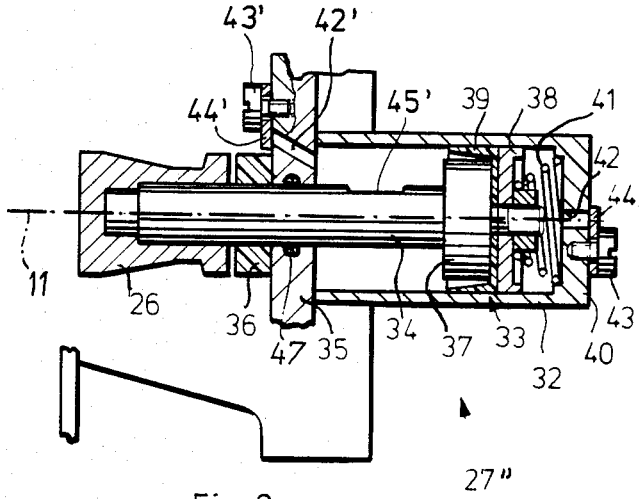

If safety pin 18 is rotated to the mode automatic fire as shown in FIGS. 2*a–c*, deceleration release lever 21 has cleared cam 18' so that after the release of the first shot (otherwise identical to the burst mode of fire) hammer 14 which is cocked due to the bolt return travel is caught at detent 24 by projection 23. Hammer 14 is retained in this position while sear 13 is kept swivelled out of the path of detent 17 by means of lug 19 of trigger 6. Catch 29 and thus projection 30 are swivelled out of the path of detent 16 by the bolt which is in the closed condition again and by release lever 31. During its return travel the bolt has not only cocked hammer 14 but also shifted piston 33 to the position shown in FIGS. 2*a–c* due to the striking action upon head 26 of piston 33, with cup leather 39 acting as a non-return valve automatically opening in this direction. After the bolt cushioned by ring 36 has advanced again by the action of the recoil spring, spring 41 urges piston 33 towards bolt carrier 9 with the piston speed being a function of the free cross section of hole 42 or 42', respectively, which can be varied by turning screw 43 and plate 44 (unless a fixed hole diameter is preferred). Piston 33 thus moves in a retarded manner until cup leather 39 has passed cross hole 45 (FIG. 2*a*) or slot 45' has passed O-ring 47, whereupon the air is allowed to flow practically unrestricted into or out of cylinder 32 through cross hole 45 or slot 45', respectively, so that piston 33 with piston rod 34 and head 26 is advanced in a not retarded manner by spring 41 until head 26 contacts arm 25 and swivels deceleration release lever 21 out of its position. This causes projection 23 to clear detent 24, allowing hammer 14 to operate and release the shot.

In this mode of fire in which deceleration member 27 is effective, the time between two shots is no longer determined by the bolt kinematics alone but essentially by the delay time determined by deceleration member 27. While in the burst position the weapon fires at an unchanged high cyclic rate of fire, the cyclic rate is reduced in the automatic fire position. The cyclic rate of fire can, for example, be adjusted to 300 shots per minute or, if desired, to a still considerably lower rate, whereby, however, the full cyclic rate of fire of the weapon is maintained in the burst mode of fire.

It is understood that deceleration member 27 can also be designed in a different manner which is known for mechanically operated deceleration members. For example, the mechanically operated deceleration could be replaced by an electrically operated deceleration member which, after run-down of its delay time releases hammer 14, for example via a magnet.

Hammer 14 is loaded in a known manner via a compression fork-type member 50 by a helical compression spring 52. In order to simplify the drawing, these components are shown broken off. Also for the sake of simplifying the drawing, the fire limiter provided in the weapon is indicated only by one gear 54 which is driven by the motion of hammer 14 in a manner not shown. Said fire limiter is described in detail in U.S. patent application No. 373,722, filed on April 30, 1982, inventor Paul Thevis, now U.S. Pat. No. 4,450,751 titled "FIRE LIMITER FOR AUTOMATIC FIREARMS WITH HAMMER BLOW DETONATION" and which claims the priority of German patent application No. P 31 20 128.8. With reference to said cited U.S. patent application the entire content of the U.S. patent application is made the content of the present patent application.

The pneumatically operated deceleration member 60 shown in FIG. 3 mainly differs from the above described deceleration member in that it is provided with a valve 66 loaded by a spring 64 in its piston 62 which valve opens automatically when piston 62 of FIG. 3 travels from the left to the right so that the air originally enclosed in the right side of piston 62 within cylinder 68 is allowed to flow into the space to the left of piston 62 via a radial hole 70. If piston 62 moves from the position shown in FIG. 3 to the left, valve 66 closes and the air enclosed left of piston 62 again flows to the right of piston 62 via a radial hole 70 and a hole 74 extending parallel to the axis which with its end neighboring hole 70 extends into a narrow throttle opening 76. In cylinder wall 80 a longitudinal slot 82 is provided which, when piston 62 has travelled a certain distance to the left enables the air to rapidly flow from the space left of piston 62 into the space to the right of piston 62, whereby the air passes a seal 86 arranged at longitudinal slot 84, thus bypassing throttle opening 76 so that spring 41 moves piston 62 as in the above described embodiment at considerable speed to the left which causes the release of hammer 14 to occur with high reliability. The arrangement shown in FIG. 3 is not affected by contamination because all components of the pneumatic deceleration mechanism are arranged within cylinder 68 and are sealed against the environmental influences by said cylinder as well as by wall 35.

The reference numerals in the claims are no limitation but are intended as an assistance for better understanding.

What we claim is:

1. In an automatic shoulder arm having a hammer acting on a firing pin and provision for changing between semi-automatic fire, burst and automatic fire modes, the improvement comprising a mechanism for reducing the cyclic rate of fire in the automatic fire mode including a linearly movable fluid pressure restrained deceleration member retracted for cushioning the recoil and returned after each shot, a detent for said hammer, a deceleration lever having a projection engaging said hammer detent, said deceleration lever being movable upon return of said deceleration member to disengage said projection from said detent and release said hammer to release the next shot, and a safety pin for selecting the modes of fire and engageable in the burst mode to move said deceleration lever to a burst position in which said projection does not engage said hammer detent.

2. In an automatic shoulder arm having a hammer acting on a firing pin and provision for changing between semi-automatic fire, burst and automatic fire modes, the improvement comprising a mechanism for reducing the cyclic rate of fire in the automatic fire mode including a linearly movable fluid pressure restrained deceleration member retracted for cushioning the recoil and returned after each shot, a detent for said hammer, a deceleration lever having a projection engaging said hammer detent, said deceleration lever being movable upon return of said deceleration member to disengage said projection from said detent and release said hammer to release the next shot, and a bolt having a forward and return path, said deceleration member comprising a spring loaded piston protruding into the return path of said bolt to be displaced against the load of the piston spring, said piston spring returning said piston to move said deceleration lever before release of the next shot, and a throttle valve controlling the return speed of the piston.

3. A shoulder arm in accordance with claim 2 wherein said throttle valve comprises a non-return valve.

4. A shoulder arm in accordance with claim 2, said shoulder arm having a cylinder guiding the piston, said throttle valve including a vent for fluid in said cylinder.

5. A shoulder arm in accordance with claim 2, said piston having a piston rod, a carrier plate supporting said piston rod, a seal on said carrier plate for said piston rod, a longitudinal slot in said piston rod located to reach and bridge said seal prior to the final displaced position of said piston, a cylinder for said piston, said longitudinal slot providing a vent for fluid in said cylinder until said seal is bridged.

6. A shoulder arm in accordance with claim 2, further including a cushion for limiting the bolt return travel, said cushion being formed by a resilient ring, said deceleration member having a collar engageable with said ring to limit the return travel of said bolt.

7. A shoulder arm in accordance with claim 6, said deceleration member piston being arranged behind the return travel limiting cushion.

8. A shoulder arm in accordance with claim 3, said non-return valve being formed by a cup leather on said piston.

9. The improvement according to claim 2 in which said piston includes a longitudinal throttle opening.

10. The improvement according to claim 2, said deceleration member having a cylinder for guiding said piston, said cylinder having a wall with a cross-hole through said wall which is exposed by said piston prior to the piston reaching a final displaced position.

11. The improvement according to claim 2, said deceleration member having a cylinder for guiding said piston, said piston having a peripheral seal and said cylinder wall having a longitudinal slot which reaches and bridges said seal prior to the piston reaching a final displaced position.

* * * * *